US006848199B1

(12) United States Patent
Giannelli

(10) Patent No.: US 6,848,199 B1
(45) Date of Patent: Feb. 1, 2005

(54) FOOTWEAR, SUCH AS A SANDAL, WITH REPLACEABLE UPPER

(76) Inventor: Roberto Giannelli, 55, Via A. del Pollaiolo, 50145 Florence (IT)

( * ) Notice: Subject to any disclaimer, the term of this patent is extended or adjusted under 35 U.S.C. 154(b) by 0 days.

(21) Appl. No.: 10/275,312

(22) PCT Filed: Oct. 31, 2000

(86) PCT No.: PCT/IT00/00436

§ 371 (c)(1),
(2), (4) Date: Nov. 5, 2002

(87) PCT Pub. No.: WO01/84973

PCT Pub. Date: Nov. 15, 2001

(30) Foreign Application Priority Data

May 5, 2000 (IT) ..... FI200000043 U

(51) Int. Cl.[7] ..... A43B 3/24
(52) U.S. Cl. ..... 36/11.5; 36/101
(58) Field of Search ..... 36/11.5, 101

(56) References Cited

U.S. PATENT DOCUMENTS 2,368,314 A * 1/1945 Marx ..... 36/11.5
3,154,866 A * 11/1964 Laufbahn ..... 36/101
3,204,346 A * 9/1965 Lockard et al. ..... 36/101
3,902,259 A * 9/1975 Cracco ..... 36/11.5
3,928,927 A 12/1975 Brown et al.
3,978,596 A * 9/1976 Brown et al. ..... 36/11.5
3,983,642 A * 10/1976 Liao ..... 36/101
4,172,330 A * 10/1979 Kao ..... 36/11.5
4,461,102 A * 7/1984 DeVincentis ..... 36/101
4,535,554 A * 8/1985 De Obaldia B. ..... 36/113
5,802,738 A * 9/1998 Ferniani ..... 36/11.5
5,852,885 A 12/1998 Ferniani
5,896,684 A 4/1999 Lin

* cited by examiner

*Primary Examiner*—Ted Kavanaugh
(74) *Attorney, Agent, or Firm*—Browdy and Neimark, P.L.L.C.

(57) ABSTRACT

A footwear, such as a sandal, a clog, a slipper, or the like, comprising a sole assembly (1) and upper strap (2) of flexable material extending from one side to other of the sole and connected to the sole by means of quick-release reversible connection (3, 4).

8 Claims, 1 Drawing Sheet

FOOTWEAR, SUCH AS A SANDAL, WITH REPLACEABLE UPPER

This application is a 371 application of PCT/IT00/00436 filed Oct. 31, 2000.

FIELD OF THE INVENTION

The present invention generally relates to footwear, such as sandals, clogs, slippers and the like and more particularly relates to such a type of footwear having replaceable upper.

BACKGROUND ART

The above mentioned types of footwear generally comprise a sole assembly, formed at least by an outsole or bottom and an insole or foot bed, and an open upper, made of leather, fabric, plastic or any other flexible material. The upper may be formed by one or more straps, some of them of adjustable length, to encircle the user's foot, such as in a sandal, or by a band transversally extending from one side to the other of the sole such as in clogs and slippers. The upper is in any case fixedly connected to the sole generally by means of gluing, screws or nails.

Due to this type of connection, which is irreversible or, anyway, hardly disassemblable by means of suitable tools only, and also for aesthetical reasons related to the color or the shape of the upper, a footwear of the above mentioned type is generally purchased to be worn in combination with a well defined type of clothing or even with a specific cloth. As a result, the possibility of use of a single pair of sandals or clogs may be relatively limited and several pairs of them are needed to match each different cloth.

SUMMARY OF THE INVENTION

The object of the present invention is to provide a footwear such as sandal, a clog, a slipper and the like which can be configured to match the type of clothing which is worn each time by the user in a simple and easy way and without the need of any tool.

The above object is reached with the footwear according to the present invention the feature of which consists in that the upper means are connected to the sole by means of quick-release reversible connection means. In this way there is made possible the removal of one upper with certain features from the sole and the application of another upper with different shape of color characteristic.

DESCRIPTION OF THE DRAWINGS

The invention will be clearer from the following description of an embodiment thereof made as a non-limiting example with reference to the attached drawing in which.

DESCRIPTION OF THE PREFERRED EMBODIMENT

Figure 1:
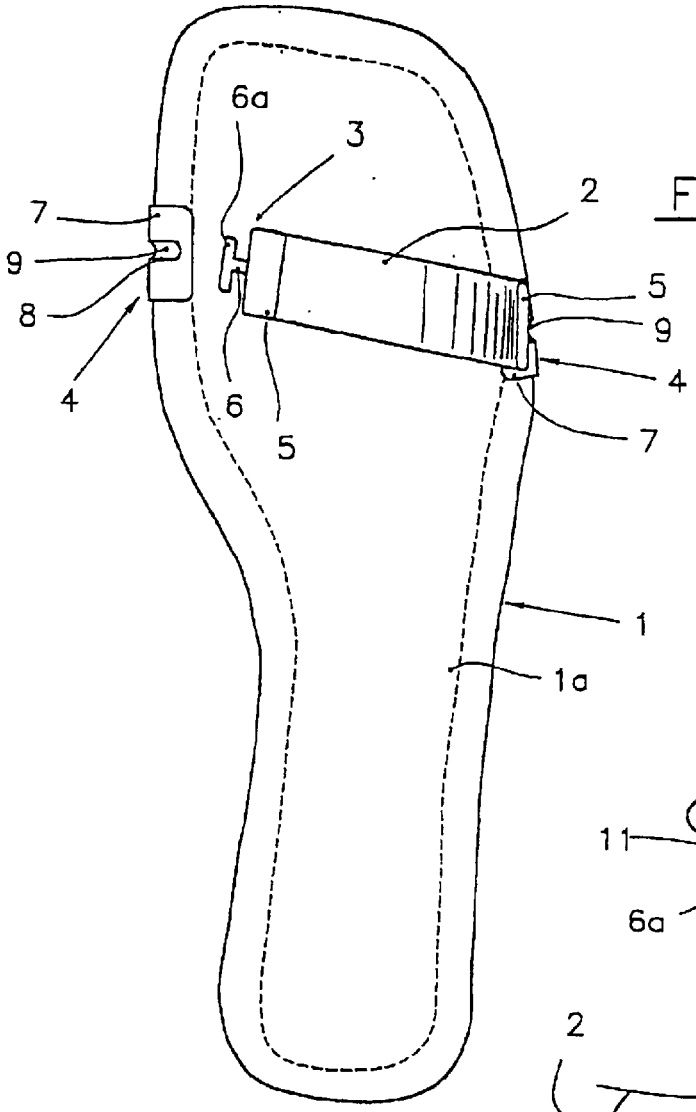
FIG. 1 schematically shows a sandal according to the invention in a plan view, provided with only one strap (for sake, of simplicity) having one end connected to the sole and the other end not connected to better show the feature of the invention.
Figure 2:
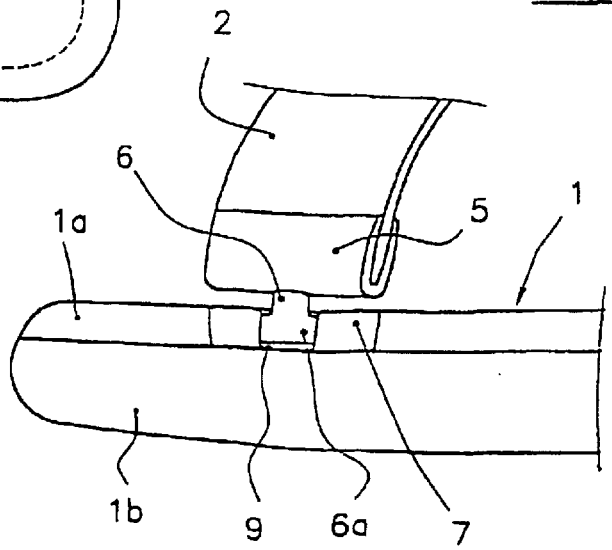
FIG. 2 is a partial side view of the front part of the sandal of FIG. 1.

With reference to FIGS. 1 and 2, 1 indicates a sole assembly comprising an insole 1*a* applied to an underlying outsole 1*b* and 2*a* generic upper in the form of a strap as in use for a sandal, typically consisting of a strip of leather or other flexible material. A male member 3 of a reversible connection is fixed to each end of strap 2, while a female member 4 is fixed to insole 1*a*. More particularly, male member 3 comprises a substantially U-bent plate 5 fixed in any known way, e.g. by clamping, to the end of strap 2, and a substantially T-shaped pin 6 defining a transverse arm 6*a* and extending from plate 5 in a substantially coplanar way with respect to strap 2. Female member 4 consists of substantially U-bent plate 7 engaging with the edge of insole in correspondence with a discontinuity of said edge so as to define a housing 9 accessible through a transverse slot 8 formed in plate 7. The width of slot 8 is sufficient to allow the passage of pin 6, while the depth of the housing delimited by plate 7 is at least equal to the length of transverse arm 6*a* of pin 6.

An equal male connection member is provided at the other end of strap 2, while an equal female connection member is correspondingly provided at the other side of insole 1.

In order to connect strap 2 to insole 1*a*, it is sufficient to axially twist strap 2 about 90° to align transverse arm 6*a* of pin 6 of male member 3 to slot 8 of female member 4 and engage arm 6*a* within the housing 9 delimited by plate 7.

Once arm 6*a* is fully inserted in said housing, an inverse 90° rotation of pin 6 put strap 2 back in its natural, untwisted position and arm 6*a* in a perpendicular position with respect to slot 8, whereby pin 6 abuts against the walls of the housing delimited by plate 7 and cannot escape therefrom.

The stability of the connection between strap 2 and insole 1 is ensured by the fact that, once that the sandal is worn, the foot exerts on strap 2 essentially tractive forces which are discharged on plate 7 by transverse arm 6*a* of pin 6. In this way, there is almost no risk that arm 6*a* could be put into alignment with slot 8 and thus escape from housing 9. The replacement of strap 2 with another one of different characteristics is equally simple, to that end being sufficient to rotate the end of strap 2, and the pin integral therewith, of an angle of about 90° to allow arm 6*a* to be disengaged from slot 8.

Figure 3:
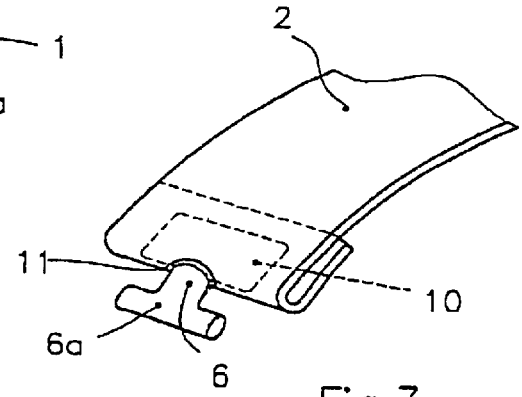
FIG. 3 is a variation of the male member of the connection means.

In a possible variation of the invention shown in FIG. 3 pin 6 can extend from a bracket 10 through a hole 11 formed in strap 2 the end of which is folded over bracket 10. In this way the visible metallic parts are minimized.

It is to be understood that, even in the present description only one strap 2 and relevant reversible connection means 3, 4 have been shown, the complete sandal will comprise other straps, namely at least an heel strap which may be provided with a buckle, and possibly other straps extending transversally with reversible connection means at the end thereof and at corresponding side points of insole 1*a*.

Furthermore, even in the present description the female connection member 4 has been foreseen to be fixed to insole 1*a* to make the construction easier, it is clear that, for example in the case in which the use of a sufficiently thick insole is not provided for, the female connection member can be directly mounted on outsole 1*b*, for example, recessed in the body thereof, only slot 8 being visible in this way.

Even if in the above description reference has been made to a sandal, it is clear that the same reversible connection means can be also applied to similar footwear, such as, in particular, a clog or a slipper, in which the upper is in the form of strips or a band of leather or other flexible material, wherein the substitution of the upper may be advantageous.

It is also clear that the relative position of the male and female members of the reversible connection can be inverted by providing male member 3 connected to insole 1*a* or to the underlying outsole 1*b* and the female member 4 to strap 2.

The invention also provides for an insole suitable to by fixed to an outsole for manufacturing a footwear with replaceable upper, the insole being provided with male/female members of a quick-release, reversible connection, the respective female/male members of the same connection being provided at the ends of the upper. By providing an insole already provided with members of the reversible connection the manufacturing of the footwear is performed at a lower production cost.

Even if the above described embodiment of the invention is considered the preferred one, the invention is not limited to it and encompasses any variation thereof. For example equivalent quick-release, reversible connection means, such as snap fasteners, velcro® elements and the like can be used as alternatives. All the above variations and modifications must be considered as comprised within the scope of the invention as set forth in the attached claims.

What is claimed is:

1. A footwear comprising a sole assembly (1) and an upper means (2) of flexible material extending from one side to the other one of said sole assembly wherein said upper means are connected to said sole assembly through quick release reversible connection means (3, 4), comprising a male member (3) formed by a substantially T-shaped pin (6) and a female member (4) extending coplanarly to said sole assembly and formed by a housing (9) accessible through a transverse slot (8) through which said pin can be passed to be releasably anchored within said housing, the T-shaped pin comprising a leg connected at a first end to the upper means and a transverse arm connected at a second end of the leg perpendicular to the leg and coplanar with respect to the upper means.

2. The footwear according to claim 1, wherein the housing (9) constituting said female member (4) is formed by a plate (7) bent in a substantially U-shape on which said slot (8) is formed.

3. The footwear according to claim 1, wherein said housing (9) constituting said female member (4) is formed in said sole (1) and said male member (3) is fixed to the end of said upper means (2).

4. The footwear according to claim 3, wherein said sole assembly (1) comprises an outsole (1*b*) and an insole (1*a*) fixed on one face of said outsole and said plate bent in a substantially U-shape is fixed to the edge of said insole (1*a*).

5. An insole (1*a*) for footwear, said footwear including upper means (2) intended for being fixed to an outsole (1*b*) of said footwear, said insole comprising at least one member of a pair of quick release reversible connection means being provided at each of two symmetrically opposed sides of the insole and adapted to be connected to a second member of said quick release reversible connection means provided at the corresponding ends of said upper means, said reversible connection means comprising a male member (3) formed by a substantially T-shaped pin (6) and a female member (4) extending coplanarly to said sole assembly and formed by a housing (9) accessible through a transverse slot (8) through which said pin (6) can be passed to be releasably anchored within it, the T-shaped pin comprising a leg connected at a first end to the upper means and a transverse arm connected at a second end of the leg perpendicular to the leg and coplanar with respect to the upper means.

6. The insole according to claim 5, in which said housing (9) constituting the female member (4) is formed by a plate (7) bent in a substantially U-shape on which said slot (8) is formed.

7. The insole according to claim 6, wherein said plate constituting said female member is applied to said insole and said male member is coplanarly fixed at the end of said upper means.

8. The insole according to claim 5, wherein said female member is applied to said insole.

* * * * *